US008292677B2

(12) United States Patent
Gassauer

(10) Patent No.: US 8,292,677 B2
(45) Date of Patent: Oct. 23, 2012

(54) PLUG-IN CONNECTOR

(75) Inventor: Stephan Gassauer, Ilfeld (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 64 days.

(21) Appl. No.: 13/038,439

(22) Filed: Mar. 2, 2011

(65) Prior Publication Data

US 2011/0217882 A1 Sep. 8, 2011

(30) Foreign Application Priority Data

Mar. 3, 2010 (DE) ..... 10 2010 010 262

(51) Int. Cl.
*H01R 4/48* (2006.01)

(52) U.S. Cl. ..... 439/729; 439/835

(58) Field of Classification Search ..... 439/729, 439/775, 784–786, 828, 834–835, 839
See application file for complete search history.

(56) References Cited

U.S. PATENT DOCUMENTS

| | | | | |
|---|---|---|---|---|
| 4,087,149 | A | 5/1978 | Fischer | |
| 6,786,779 | B2 * | 9/2004 | Feldmeier et al. | 439/729 |
| 7,255,609 | B1 * | 8/2007 | Epstein | 439/729 |
| 7,510,448 | B2 * | 3/2009 | Eppe et al. | 439/835 |

FOREIGN PATENT DOCUMENTS

| | | |
|---|---|---|
| DE | 197 10 422 | 8/1998 |
| DE | 10 2007 018 443 | 11/2007 |
| DE | 10 2008 062 137 | 6/2010 |
| GB | 1 528 993 | 10/1978 |

* cited by examiner

*Primary Examiner* — Khiem Nguyen
(74) *Attorney, Agent, or Firm* — Whitham Curtis Christofferson & Cook, PC

(57) ABSTRACT

In a plug-in connector (1), at least one part of the busbar element (10) is in each case arranged in the boundary area between an associated conductor entry opening (3) and an associated contact pin receiving opening (8) in such a manner that the part of the busbar element (10) is located between a contact pin (14) and an electric conductor (5) and electrically conductively rests against the contact pin (14) and the electric conductor (5). The busbar element (10) has a resilient contact area in the contact pin receiving opening (8) for electrically contacting the busbar element (10) by a spring force with a contact pin (14) which can be inserted into an associated contact pin receiving opening (8).

11 Claims, 18 Drawing Sheets

PLUG-IN CONNECTOR

The invention relates to a plug-in connector comprising:

an enclosure of insulating material at least one conductor entry opening, open toward a conductor connection side of the plug-in connector, which in each case leads into an associated conductor connection space in the enclosure of insulating material for electrically conductively connecting an electric conductor introduced into a conductor entry opening, in each case one clamping spring element arranged in the conductor connection space, which element has a supporting leg for localizing the clamping spring element and a clamping leg for clamping an electric conductor, at least one contact pin receiving opening for introducing contact pins, the contact pin receiving opening leading into in each case an associated conductor connection space and being open toward a contact pin connection side different from the conductor connection side, and in each case one- or multi-part busbar element in the conductor connection space which is constructed for forming a clamping point for an associated electric conductor in such a manner that an electric conductor introduced into a conductor entry opening is pressed against the busbar element by the clamping leg of the clamping spring element.

Plug-in connectors in which an electric conductor can be inserted into a conductor entry opening from one side and a contact pin into a contact pin receiving opening from the opposite side and in which the electric conductor is pressed against the contact pin by a clamping spring arranged opposite the contact pin in the enclosure of insulating material are known, for example, from DE 10 2007 018 443 A1. In the boundary area between the contact pin and the electric conductor, an electrically conductive partition can be arranged movably which forms a current bridge between the contact pin and the electric conductor.

The contact pin rests against the intermediate plate as a result of which a contact resistance is formed between the contact pin and electric conductor. This is formed by the contact pressure applied by the clamping spring.

GB 1 528 993 discloses a plug-in connector in which a contact pin is received in a spring section of the clamping spring below the clamping spring. The clamping spring and the busbar piece for contacting an electric conductor are constructed as one piece in this arrangement.

US 2009/0035998 A1 describes a plug-in connector in which the end of the clamping spring opposite the clamping end is bent over for forming a contact receptacle for a contact pin. In this arrangement, the clamping spring is used at the same time as a busbar element in order to transfer the current from the contact pin to the electric conductor and back. However, the electrical conductivity of resilient metal alloys is not as optimal as the conductivity, for example, of a busbar element formed of copper which only has reduced spring characteristics. In practice, therefore, separate clamping spring elements made of spring plates and busbar elements made of electrically more conductive material such as copper alloys are used.

U.S. Pat. No. 4,084,149 A discloses a plug-in connector in which an electric conductor rests directly against a contact pin and is pressed against the contact pin with the aid of a bent-over spring. In this arrangement, the free clamping end rests against the electric conductor whilst the opposite supporting leg rests against the contact pin.

Furthermore, a plug-in connector is known from DE 197 10 422 C1, in which a resilient intermediate plate is arranged between the electric conductor and the contact pin, which plate forms a spring force between contact pin and electric conductor and a current bridge between electric conductor and contact pin. On the opposite sides, the electric conductor and the contact pin in each case rest against the enclosure of insulating material or a busbar piece.

On the basis of this, it is the object of the present invention to create an improved plug-in connector in which an electric conductor is pressed with a contact spring against a busbar element and in which a contact pin on the side opposite the electric conductor and the clamping spring contacts the electric busbar element. In this arrangement, the current path between contact pin and electric conductor should be as short as possible and the contact resistance between contact pin and electric conductor should be as low as possible.

The object is achieved by means of the plug-in connector of the type initially mentioned, in that the at least one part of the busbar element is in each case arranged in the boundary area between an associated conductor entry opening and an associated contact pin receiving opening in such a manner that the piece of the busbar element is located between a contact pin and an electric conductor and electrically conductively rests against the contact pin and the electric conductor and in that the at least one busbar element has a resilient contact area in the contact pin receiving opening for electrically contacting the busbar element by a spring force with a contact pin which can be introduced into an associated contact pin receiving opening.

Due to the fact that the contact pin rests directly against the busbar element and contacts the electric conductor adjoining directly in the boundary area between an associated conductor entry opening and an associated contact pin receiving opening, i.e. between contact pin and electric conductor, the current path in the busbar element serving as current bridge is reduced. The voltage drop occurring across the contact point between contact pin and electric conductor is reduced in this manner. In addition, the reliability of contact is improved.

In a preferred embodiment, the busbar element is constructed as one piece. The busbar element is bent over above the free end of a contact pin which can be introduced into an associated contact pin receiving opening. In this manner, the busbar element overlaps a contact pin and contacts it resiliently with its bent-over free end area.

Due to the bent-over free end area, it is possible to establish a good electrically conductive contact between contact pin and busbar element and the adjoining electric conductor in a space- and material-saving manner. The contact pin can be introduced simply into the receiving shoe, formed by the bent-over free end, of the busbar element. The current path from contact pin to electric conductor is very short so that the contact resistances are low.

In this arrangement, the bend located above a contact pin can form a spring bow so that the free end of a busbar element is preloaded in the direction of the boundary area part of the busbar element located between an associated conductor entry opening and an associated contact pin receiving opening in order to rest against a contact pin by means of spring force.

As an alternative or additionally thereto, it is conceivable that the free end of the busbar element in the contact pin receiving opening is bent over in the direction of the conductor connection space and has a fork comprising two clamping legs between which a contact pin can be clamped. Using such a fork, a good electric contact can be established between busbar element and contact pin so that a part of the current can flow via this fork and the bent-over part of the busbar element in the direction of the electric conductor. In addition, the contact pin rests laterally against the busbar element over a part of its length so that current can also flow directly from the contact pin through the busbar element to the adjoining electric conductor.

In another embodiment, the busbar element can have, in the lower area opposite to the conductor entry opening, a fork protruding into the contact pin receiving opening, forming the contact area, comprising two spaced-apart clamping legs for clamping a contact pin at opposite sides of the contact pin. This embodiment saves a lot of material and does not need any additional material for the busbar element. This is because the clamping legs of the fork can be simply cut out or stamped out of the plate part of the busbar element and bent over from the plane of the busbar element in the boundary area between an associated conductor entry opening and an associated contact pin receiving opening into the contact pin receiving opening. Such a fork forms a good spring contact with sufficient current transition values. Very short contact pins can be used and a long electrical cover is provided in the case of longer contact pins.

Forming the fork in the lower area of the busbar element also has the advantage that the current path between the fork and supporting area for the electric conductor is kept small.

In this embodiment, the clamping legs of the busbar element, which form the fork, can be bent away toward the top in the contact pin receiving opening opposite the boundary area, between an associated conductor entry opening and an associated contact pin receiving opening, of an inlet of the contact pin receiving opening in the enclosure of insulating material in the direction of the inlet of the conductor entry opening in the enclosure of insulating material. By this means, the supporting area of the clamping legs on the contact pin is enlarged in that the mutually opposite edges of the bent-over clamping legs, which form the fork, electrically contact the contact pin. In addition, the elasticity of the clamping legs is increased so that the compensation for tolerances is improved.

In a further advantageous embodiment, the busbar element can protrude at its two opposite side edges into the contact pin receiving opening and have contact walls folded away from the part piece of the busbar located in the boundary area between an associated conductor entry opening and an associated contact pin receiving opening, for electrically contacting an intermediate contact pin.

This embodiment requires somewhat more material for the busbar piece. In this arrangement, contact walls extending in parallel with one another on both sides are formed from a plate part and folded over. The contact pin then rests against the two contact walls and is contacted in a resiliently pressed-in manner by the contact walls. Using the contact walls, it is possible to provide an adequate contact area to the contact pin independently of the angle of insertion of the contact pin.

In an alternative embodiment, it is conceivable that the busbar element has several parts and has a spring element acting in the direction of the conductor connection space in the contact pin receiving opening opposite the boundary area between contact pin and electric conductor and pressing against the contact pin resiliently against the part of the busbar element located in the boundary area between contact pin and electric conductor. Thus, a spring element resiliently acting into the contact pin receiving opening is built into the enclosure of insulating material, e.g. in the form of a spring plate which presses the contact pin in the direction of a second part of the busbar element arranged in the boundary area between the contact pin and the electric conductor so that the contact pin is electrically conductively connected to the busbar element located between the electric conductor and the contact pin.

The spring element can be, e.g., a part of the busbar element which is separate from the part of the busbar element located in the boundary area between an associated conductor entry opening and an associated contact pin receiving opening, i.e. between contact pin and electric conductor. However, it is also conceivable that the spring element is formed as one piece with the part of the busbar element located in the boundary area between contact pin and electric conductor. However, this requires more material and is more expensive to produce.

In another embodiment, the busbar element can have a first part located in the boundary area between contact pin and electric conductor, extending in parallel with the direction of extension of the conductor entry opening and contact pin receiving opening, and a second clamping part connected to the first part and extending in the direction of the inlet of the contact pin receiving opening in the enclosure of insulating material for the contact pin and protruding into the contact pin receiving opening with two contact legs, mutually spaced apart for receiving an intermediate contact pin, and mutually spring-loaded, for clamping a contact pin. Such a clamping part with two mutually spaced-apart contact legs spring-loaded against one another is used for electrically contacting an inserted contact pin with the mutually opposite inside edges of the contact legs of the clamping part. In distinction from the one-part embodiment, described above, of a fork from the busbar element, the clamping part in the present embodiment is shaped separately from the busbar element. It can be formed of the same or preferably of different material. Thus, it is advantageous if the clamping part has better spring characteristics than the busbar element which should be optimized with regard to its conductivity. The clamping part is then permanently or detachably connected to the busbar element located in the boundary area between contact pin and electric conductor and is preferably welded to the busbar element.

In all the embodiments described, it is particularly advantageous if the busbar element has, in the boundary area between an associated conductor entry opening and an associated contact pin receiving opening, a bulge protruding from the contact pin receiving opening into the conductor entry opening, which bulge provides a reduced supporting area for an electric conductor pressed against the busbar element by the clamping spring. This concentrates the force of the clamping spring against the bulge as a result of which the contact resistance of the contact is reduced.

In the text which follows, the invention will be explained in greater detail with reference to illustrative embodiments, by means of the attached drawings in which.

Figure 1:
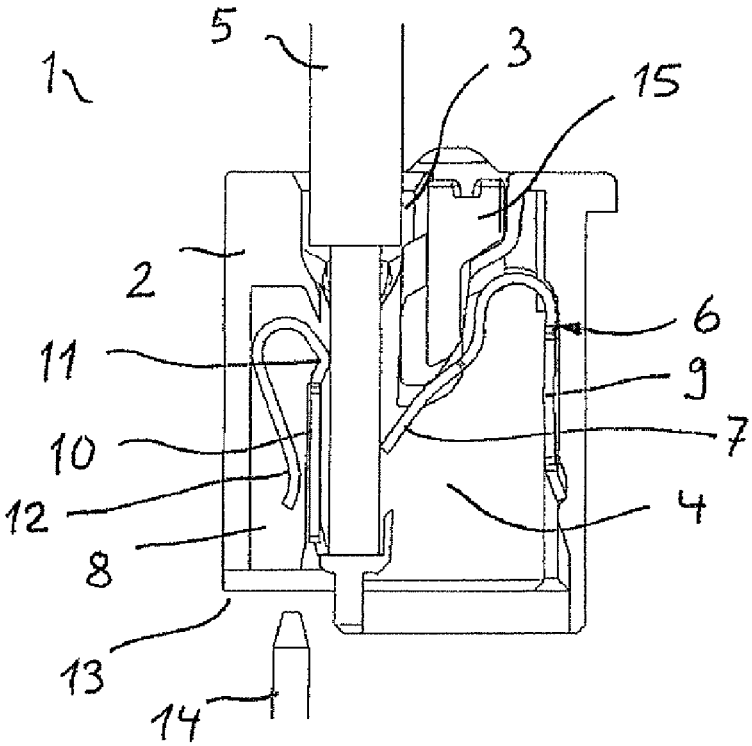
FIG. 1 shows a sectional view of a first embodiment of a plug-in connector.

FIG. 1 discloses a sectional view of a first embodiment of a plug-in connector 1 in cross section. The plug-in connector 1 has an enclosure 2 of insulating material into which a conductor entry opening 3 is inserted which leads into a conductor connection space 4. An electric conductor 5 can be inserted into the conductor connection space 4 through the conductor entry opening 3. In the conductor connection space 4, a clamping spring element 6 is installed, the clamping leg 7 of which presses against the electric conductor 5 and exerts a force in the direction of a contact pin receiving opening 8. The clamping spring element 6 is fixed in the enclosure 2 of insulating material by means of a supporting leg 9.

Between the contact pin receiving opening 8 and the electric conductor 5 or the conductor connection space 4, respectively, a busbar element 10 is installed. The busbar element 10 has a bulge 11 which protrudes in a direction of the conductor connection space 4 in order to establish a defined reduced supporting area for the electric conductor 5. The force of the clamping spring element 6 is thus concentrated on this bulge 11.

Above the bulge 11, the clamping spring element 10 is bent over and is directed with its free end 12 toward a contact pin connection side 13 for introducing a contact pin 14 into the contact pin receiving opening 8.

Furthermore, an operating pusher 15 for opening the clamping spring element 6 can be installed in the enclosure 2 of insulating material.

Figure 2:
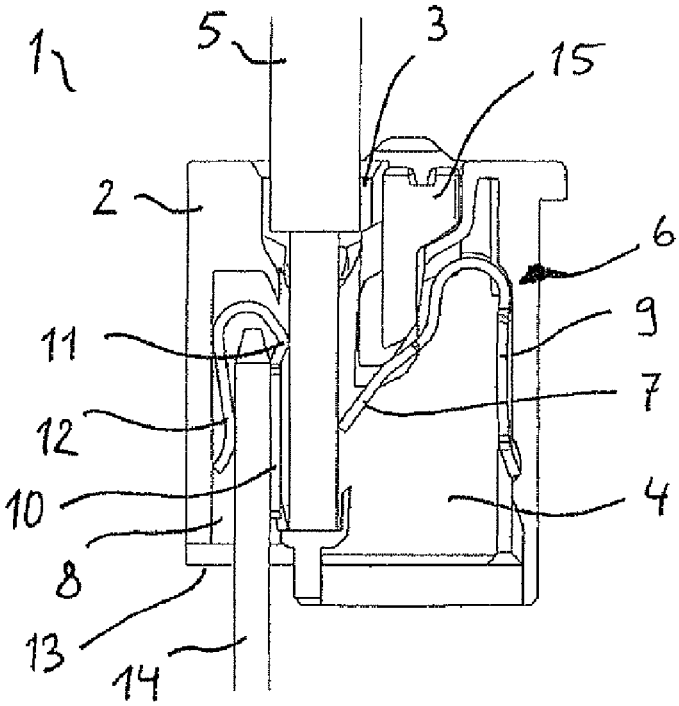
FIG. 2 shows a sectional view of the first embodiment of the plug-in connector from FIG. 1 with the contact pin inserted.

FIG. 2 discloses the plug-in connector 1 from FIG. 1 with contact pin 14 inserted into the contact pin receiving opening 8. It becomes clear that the busbar element 10 overlaps the contact pin 14 with its bent section above the bulge 11. Furthermore, it becomes clear that the free end 12 of the busbar element 10 presses resiliently against the contact pin 14 in the direction of conductor connection space 4 and places the contact pin 14 so as to rest closely against the busbar element 10. Thus, a current can flow from the electric conductor 5 via the busbar element 10 on a short path to the contact pin 14 and back. The current path is very short and the contact resistances are low.

Figure 3:
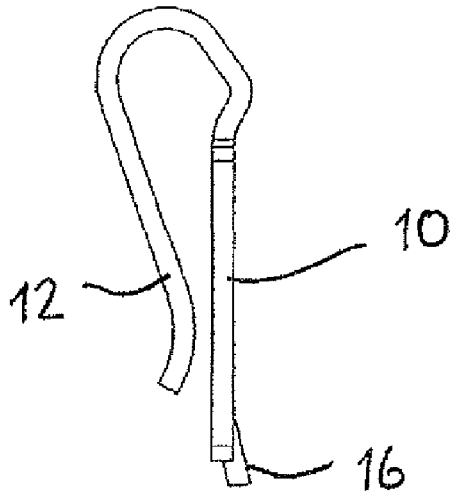
FIG. 3 shows a busbar element of the plug-in connector from FIG. 1 in a side view.

FIG. 3 shows a side view of the busbar element 10 for the plug-in connector 1 from FIGS. 1 and 2. Apart from the bent-over resilient free end area 12, a bent-away material tab 16, by means of which a conductor capture pocket for the end of the electric conductor 5 is formed, can be seen especially at the lower end.

Figure 4:
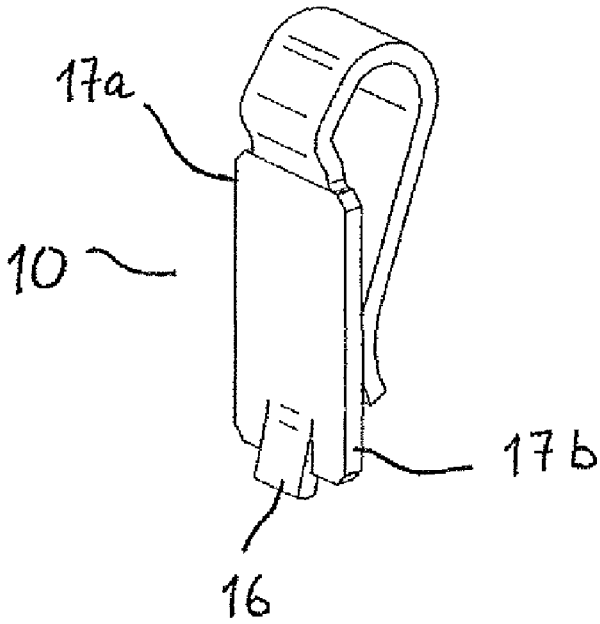
FIG. 4 shows a perspective view of the busbar element of the plug-in connector from FIG. 1.

FIG. 4 shows the busbar element 10 from FIG. 3 in a perspective rear view. It becomes clear that the supporting area, located in the boundary area between an associated conductor entry opening 3 and an associated contact pin receiving opening 8, of the busbar element 10 has laterally protruding wings 17*a*, 17*b* which can be accommodated in corresponding grooves in the enclosure 2 of insulating material of the plug-in connector 1. Using these wings 17*a*, 17*b*, the busbar element 10 is permanently mounted in the enclosure 2 of insulating material.

Figure 5:
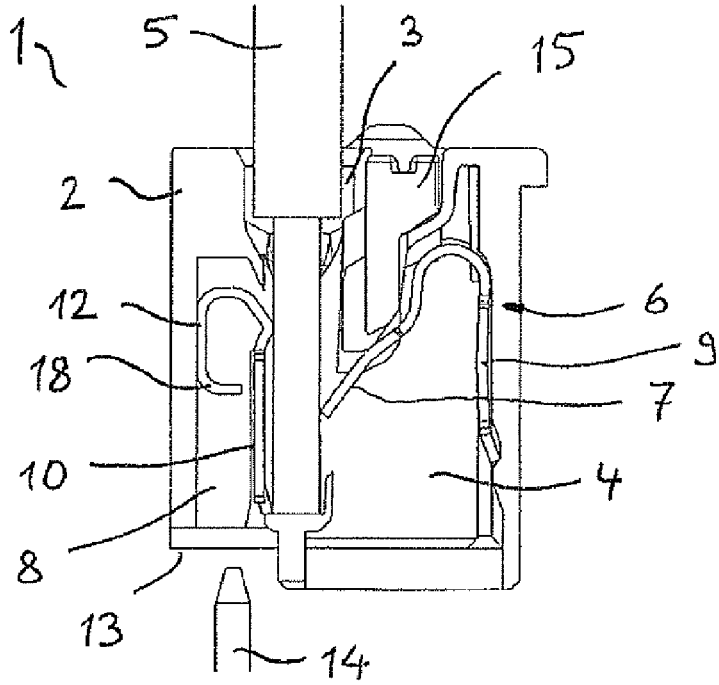
FIG. 5 shows a cross-sectional view of a second embodiment of a plug-in connector.
Figure 6:
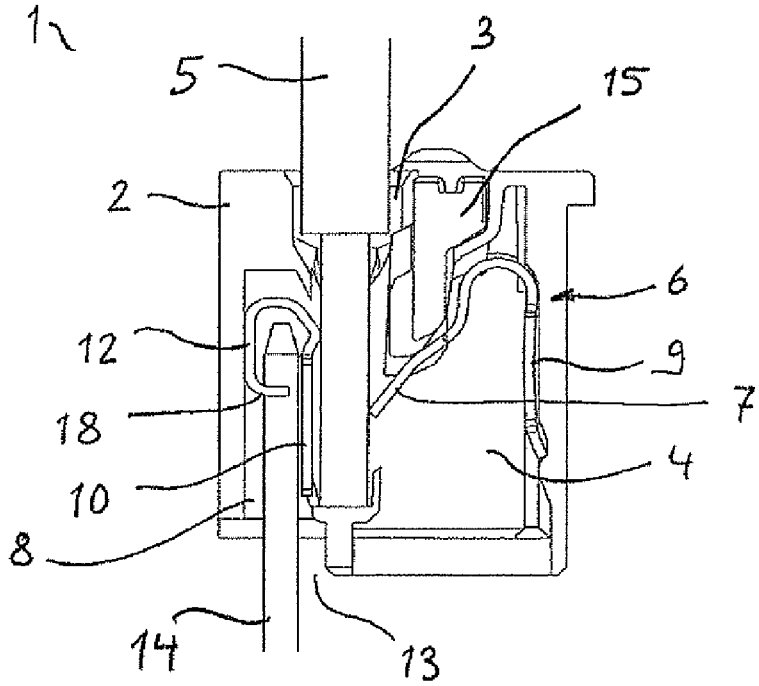
FIG. 6 shows a cross-sectional view of the plug-in connector from FIG. 5 with the contact pin inserted.

FIG. 5 shows a second embodiment of a plug-in connector 1 which is constructed similarly to the plug-in connector 1 from FIG. 1. The busbar element 10 is again bent over above the contact pin 14 as can be seen in FIG. 6. The free end 12 is again bent over in the direction of the conductor connection space 4 in the contact pin receiving opening 8 and forms a fork 18 having two clamping legs 19*a*, 19*b* between which a contact pin 14 can be clamped (see FIG. 6).

Figure 7:
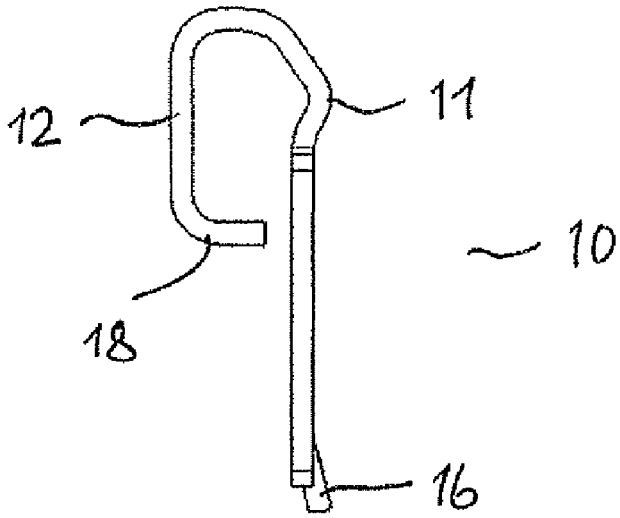
FIG. 7 shows a busbar element of the plug-in connector from FIG. 5 in a side view.
Figure 8:
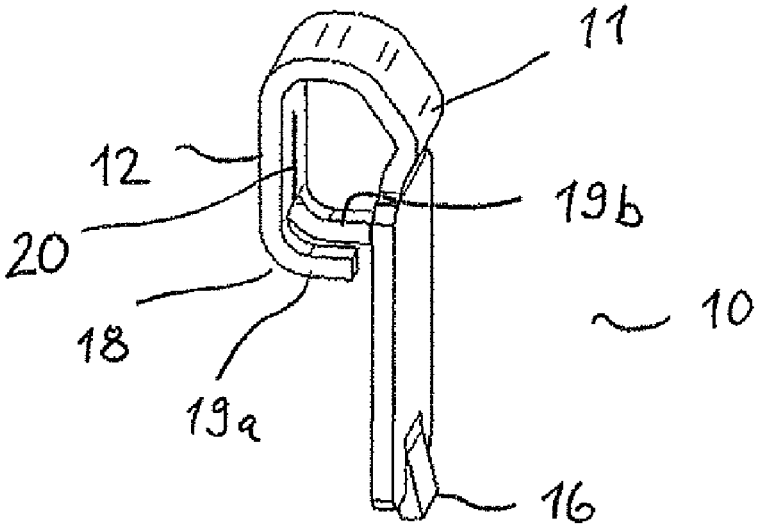
FIG. 8 shows a perspective side view of the busbar element of the plug-in connector from FIG. 5.

The fork 18 with its two opposite clamping legs 19*a*, 19*b* can be seen in the side view of FIG. 7 and especially in the perspective view of FIG. 8.

The perspective view of FIG. 8 also shows that there can be a further slot 20 in the part adjoining the fork 18, by means of which an improved spring store for the fork 18 can be created.

Figure 9:
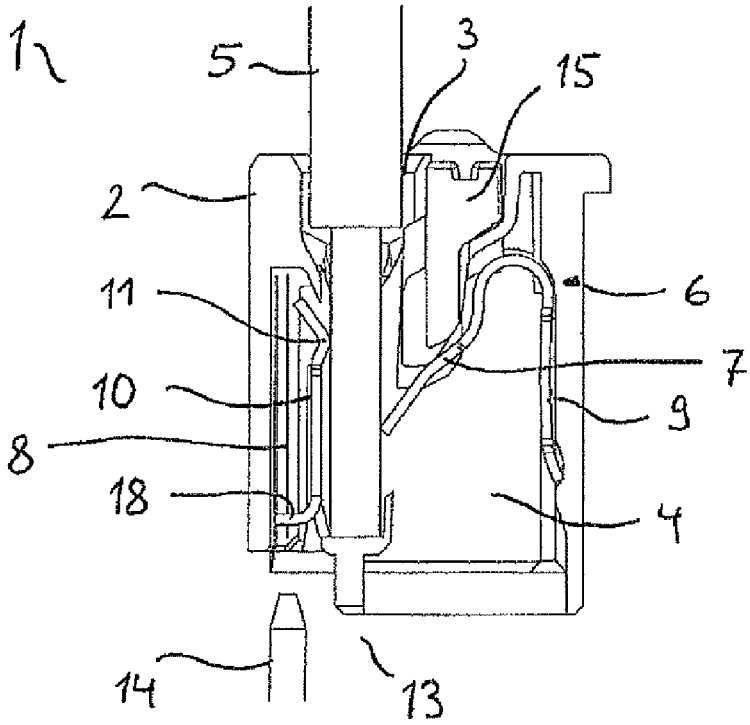
FIG. 9 shows a cross-sectional view of a third embodiment of a plug-in connector.
Figure 10:
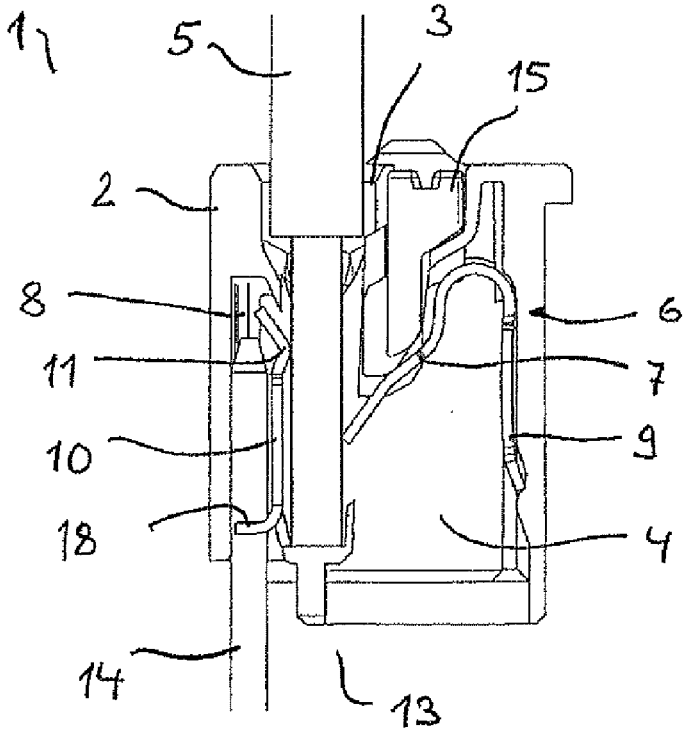
FIG. 10 shows a cross-sectional view of the plug-in connector from FIG. 9 with the contact pin inserted.

FIG. 9 shows a third embodiment of a plug-in connector 1 in a cross-sectional view and FIG. 10 shows said embodiment with the contact pin 14 inserted. In this embodiment, a fork 18 is formed at the lower end area of the busbar element 10. The contact pin 14 is encircled by this fork 18 and contacted there electrically conductively.

Figure 11:
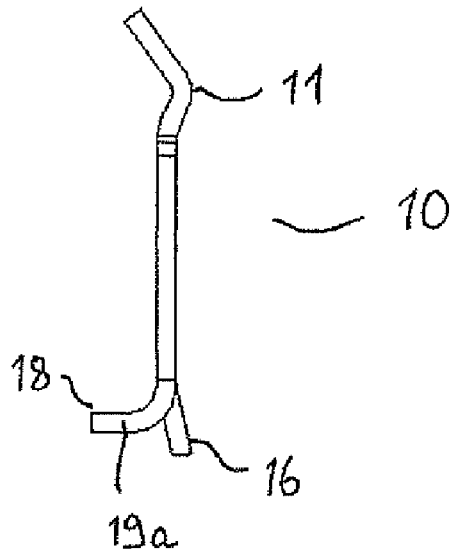
FIG. 11 shows a side view of the busbar element for the plug-in connector from FIG. 9.
Figure 12:
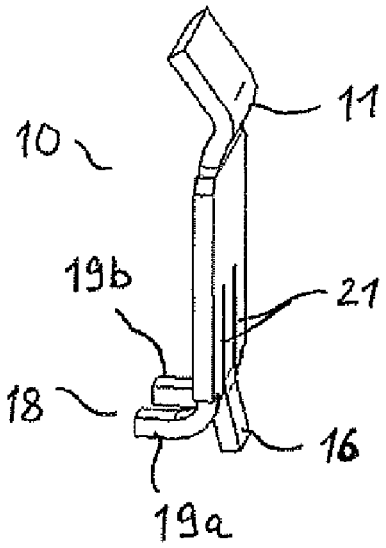
FIG. 12 shows a perspective view of the busbar element according to FIG. 11.
Figure 13:
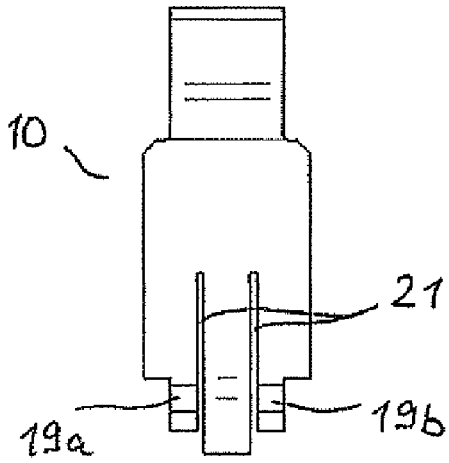
FIG. 13 shows a rear view of the busbar element from FIGS. 11 and 12.

This special embodiment of the busbar element 10 is shown in a side view in FIG. 11, in a perspective view in FIG. 12 and in a rear view in FIG. 13. This shows clearly that the fork 18 is formed integrally with the busbar element 10 from one sheet metal part in that a centerpiece of the sheet metal part in the lower area is provided for forming two clamping legs 19*a*, 19*b* by means of slots 21. The slots 21 provide for an adequate spring effect of the clamping legs 19*a*, 19*b* of the fork 18. When a contact pin 14 is inserted, the clamping legs 19*a*, 19*b* bend to open away from one another and hold the contact pin 14 tight under spring force. In this manner, the contact pin 14 is electrically conductively contacted at the inside edges of the clamping legs 19*a*, 19*b* with little contact resistance.

Figure 14:
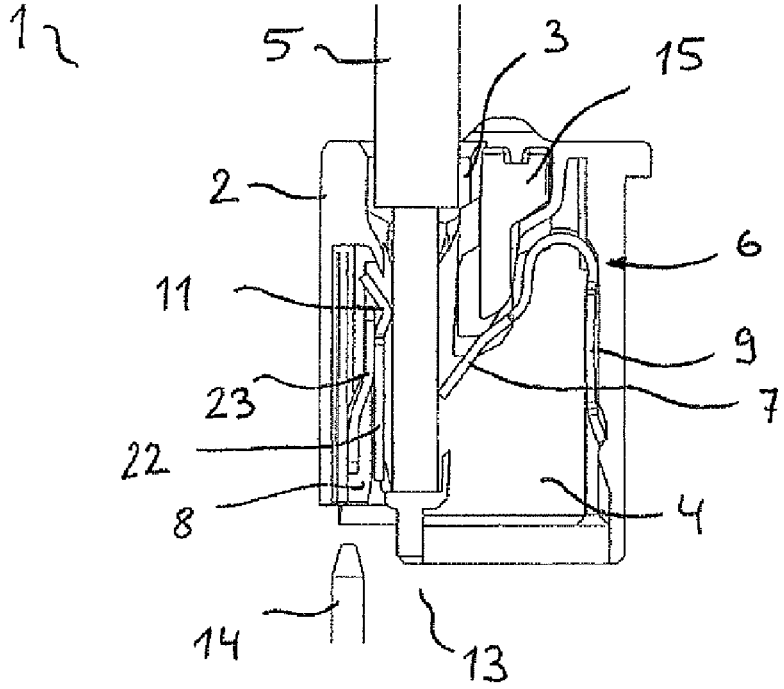
FIG. 14 shows a cross-sectional view of a fourth embodiment of a plug-in connector.
Figure 15:
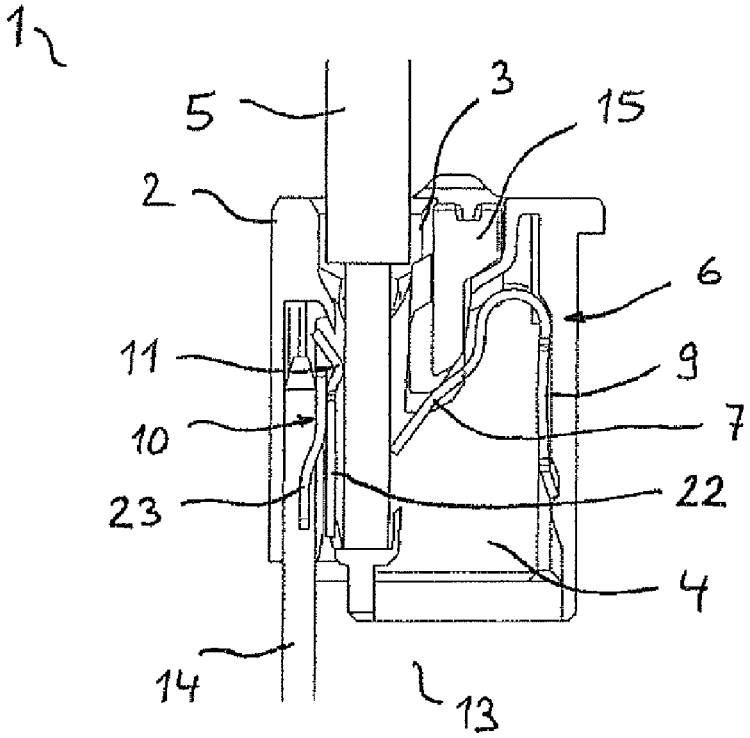
FIG. 15 shows a cross-sectional view of the plug-in connector from FIG. 14 with the contact pin inserted.

A fourth embodiment of a plug-in connector 1 is outlined in FIGS. 14 and 15. In this embodiment, the busbar element 10 is constructed in two parts. It consists of a supporting part 22 located in the boundary area between an associated conductor entry opening 3 and an associated contact pin receiving opening 8, which part adjoins the electric conductor 5 and carries the bulge 11, and a clamping part 23. The clamping part 23 is connected to the supporting part 22 adjacently to the bulge 11. The connection can be made, for example, by welding, soldering, riveting or similar. The connection in this area adjoining the bulge 11 shortens the current path to the greatest extent.

Figure 16:
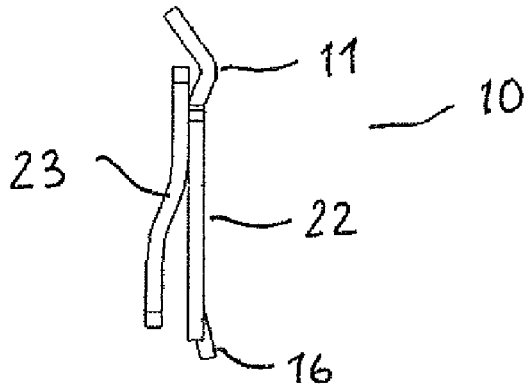
FIG. 16 shows a side view of a two-part busbar element.
Figure 17:
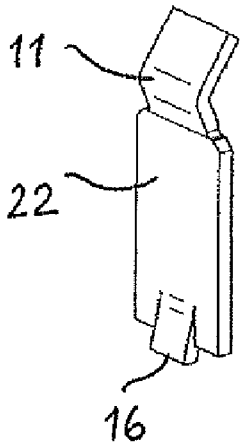
FIG. 17 shows a perspective view of a first part of the busbar element from FIG. 16.
Figure 18:
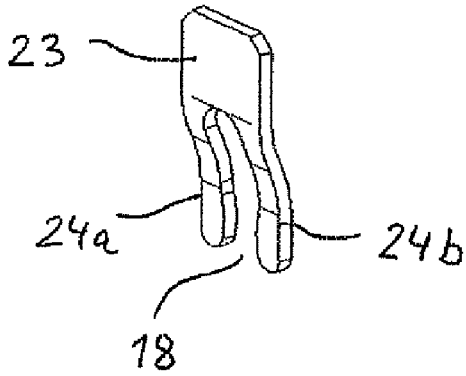
FIG. 18 shows a perspective view of a second part of the busbar element from FIG. 16.

The two-part busbar element 10 is outlined more clearly in FIGS. 16, 17 and 18 in the side view and perspective view of the individual parts. It can be seen that the clamping part 23 has at its lower end a fork 18 with two mutually spaced-apart contact legs 24*a*, 24*b* between which a contact pin 14 can be resiliently clamped and thus electrically contacted.

To optimize the functions of the resilient clamping of a contact pin and of the current transmission through the busbar element 10, the supporting part 22 and the clamping part 23 can be manufactured from different materials. Thus, the supporting part can be of an electrically very conductive but not optimally selected material with regard to the spring characteristics, such as, for example, copper. In contrast, the clamping part can be formed of a spring material which is not optimal with regard to its electrical conductivity.

Figure 19:
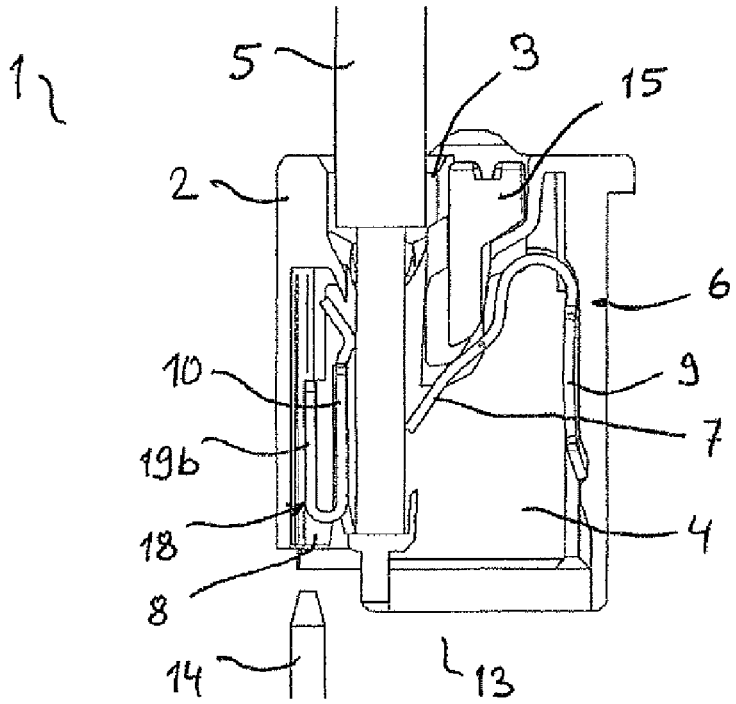
FIG. 19 shows a cross-sectional view of a fifth embodiment of a plug-in connector.
Figure 20:
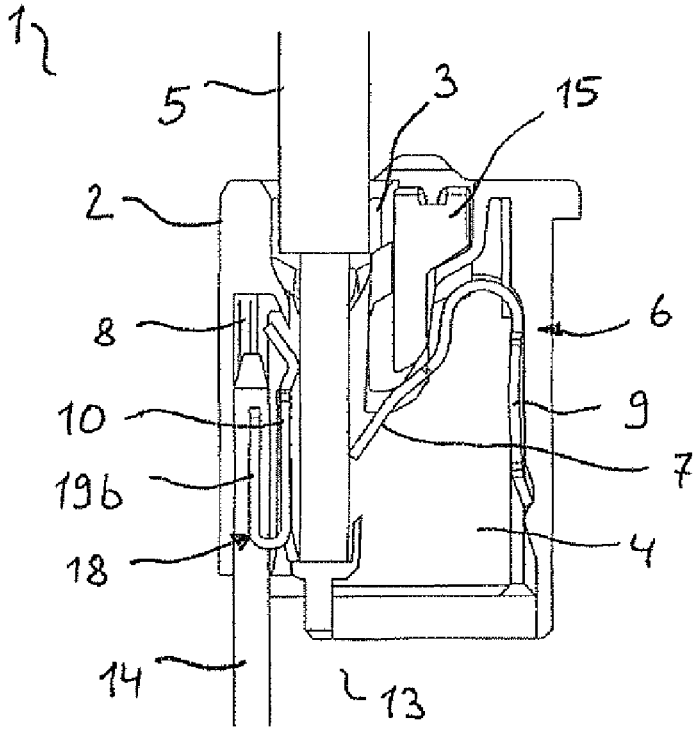
FIG. 20 shows a cross-sectional view of the plug-in connector from FIG. 19 with the contact pin inserted.

FIGS. 19 and 20 show a fifth embodiment of a plug-in connector 1 which, in principle, is comparable to the third embodiment. Here, too, the one-piece busbar element 10 has in the lower area a fork 18 bent over in the direction of the contact pin receiving opening. However, this fork is bent up again in the direction of the conductor entry opening 3 opposite the boundary area, adjoining the electric conductor 5, between conductor entry opening 3 and contact pin receiving opening 8.

Figure 21:
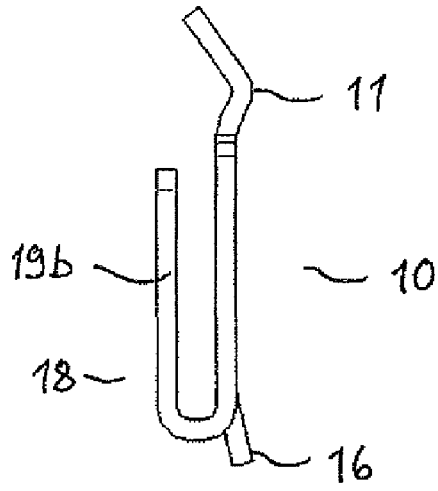
FIG. 21 shows a side view of the busbar element for the plug-in connector from FIG. 19.
Figure 22:
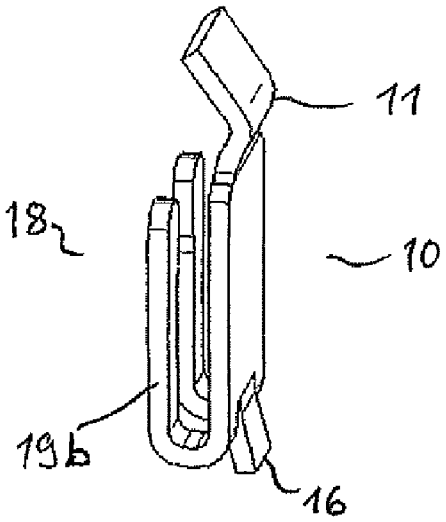
FIG. 22 shows a perspective view of the busbar element according to FIG. 21.
Figure 23:
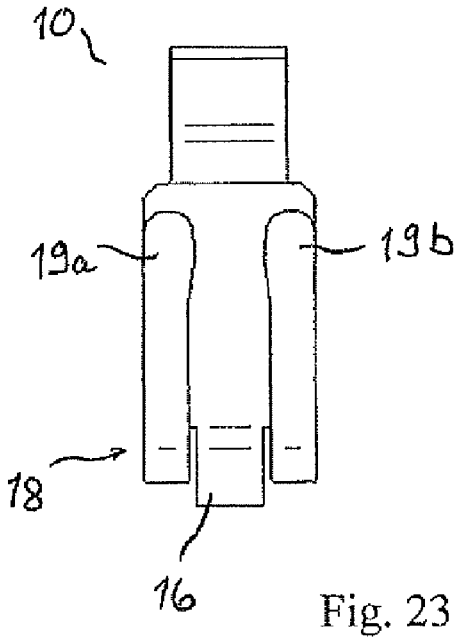
FIG. 23 shows a front view of the busbar element from FIG. 21.

FIGS. 21 to 23, which show the busbar element 10 in the fifth embodiment, show clearly that the clamping legs 19*a*, 19*b* of the fork 18 have in the upper area in each case a bulge against which the contact pin preferably rests. Due to the elongation of these clamping legs 19*a*, 19*b* in comparison with the third embodiment, the spring arm is enlarged and the clamping force is thus increased.

Figure 24:
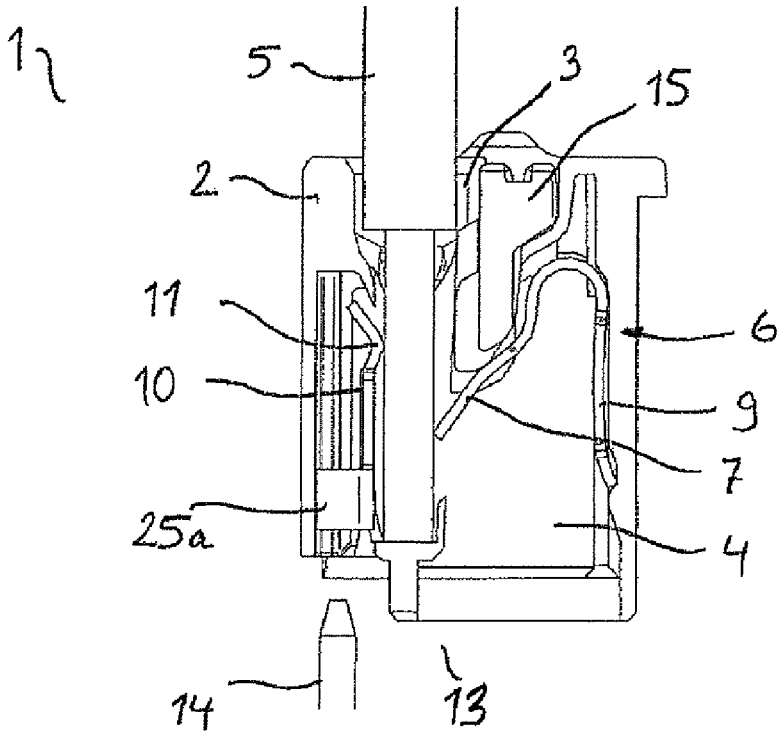
FIG. 24 shows a cross-sectional view of a sixth embodiment of a plug-in connector.
Figure 25:
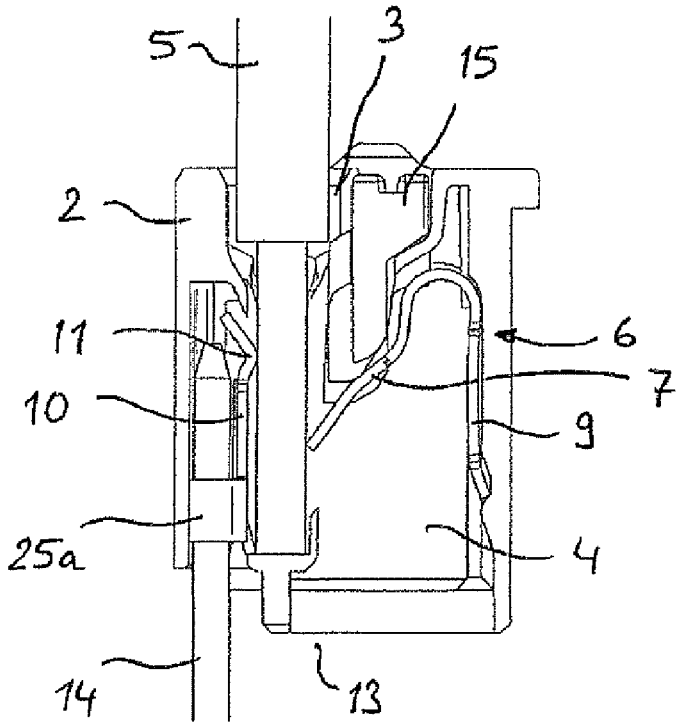
FIG. 25 shows a cross-sectional view of the plug-in connector from FIG. 24 with the contact pin inserted.

FIGS. 24 and 25 show a sixth embodiment of a plug-in connector 1 in which a busbar element 10 has in the lower area contact walls 25*a*, 25*b* bent away from the part piece, located in the boundary area between the conductor entry opening 3 and contact pin receiving opening 8, of the busbar element 10, between which walls a contact pin 14 is received and electrically contacted.

Figure 26:
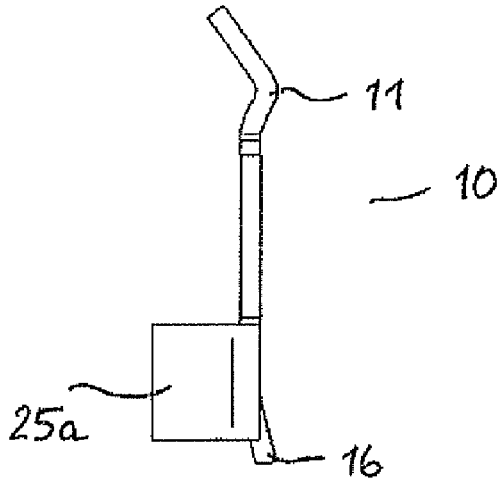
FIG. 26 shows a side view of the busbar element for the plug-in connector from FIG. 24.
Figure 27:
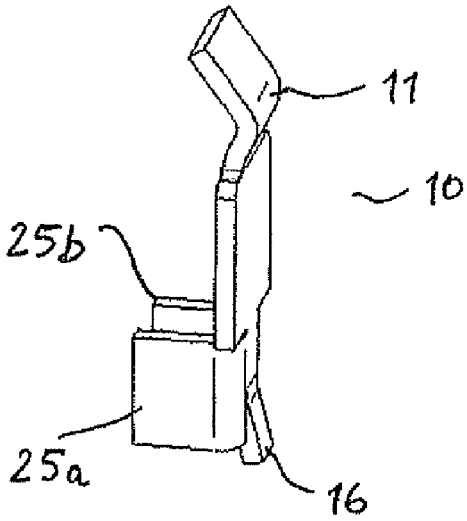
FIG. 27 shows a perspective rear view of the busbar element from FIG. 26.
Figure 28:
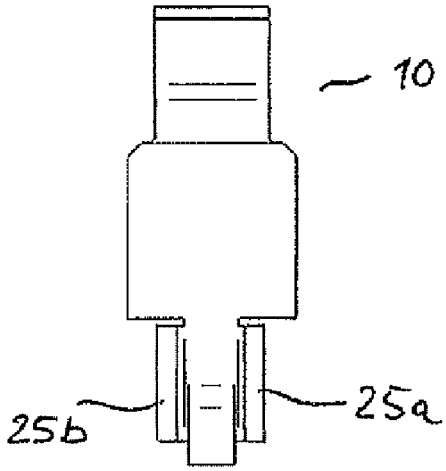
FIG. 28 shows a front view of the busbar element from FIG. 26.

The representation of the busbar element 10 in FIGS. 26 to 28 shows clearly that two contact walls 25*a*, 25*b* are folded over at the side edges of the busbar element 10 at a distance from one another in such a manner that they extend into the contact pin receiving opening 8. A contact pin 14 is held at the insides of the contact walls 25*a*, 25*b* in an electrically conductive contact.

Figure 29:
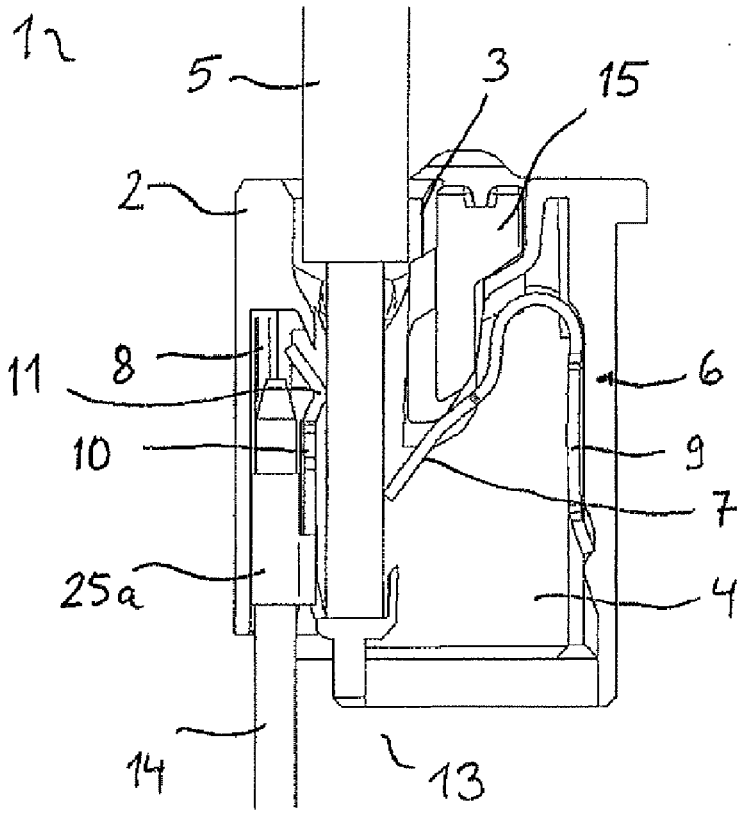
FIG. 29 shows a cross-sectional view of a seventh embodiment of a plug-in connector.
Figure 30:
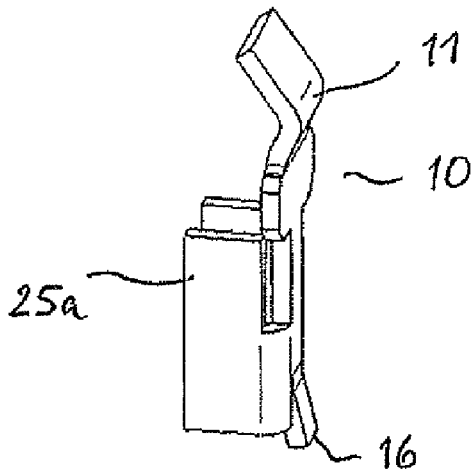
FIG. 30 shows a perspective side view of the busbar element for the plug-in connector from FIG. 29.

FIG. 29 shows a seventh embodiment of a plug-in connector 1 which is comparable to the sixth embodiment from FIGS. 24 and 25. However, the contact walls 25*a*, 25*b* are here elongated toward the top in the direction of the conductor entry opening 3. In this manner, the clamping force can be increased. This is achieved by the fact that the contact walls 25*a*, 25*b* are spaced apart from the busbar element 10 in the upper area by slots, so that a spring arm is formed.

Figure 31:
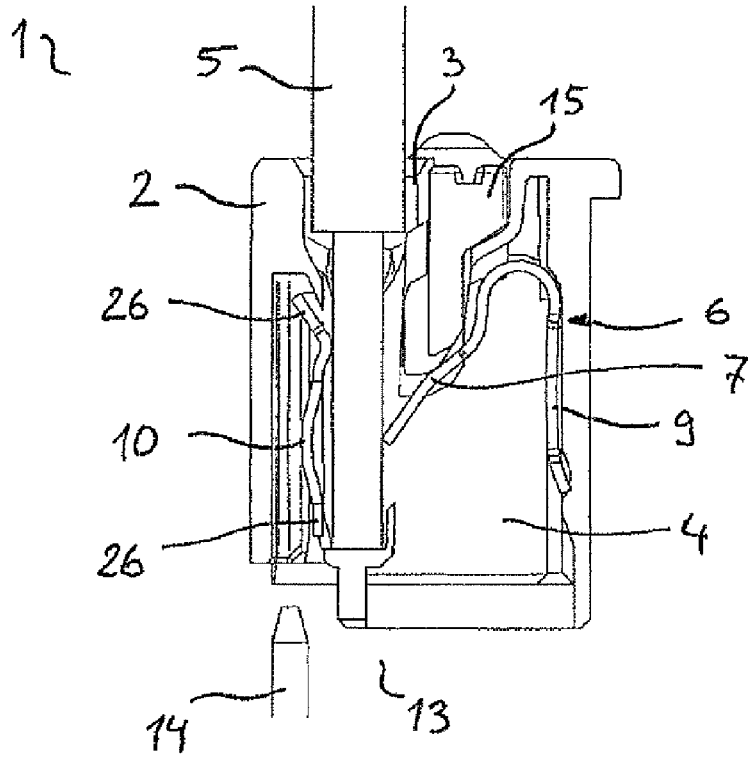
FIG. 31 shows a cross-sectional view of an eighth embodiment of a plug-in connector.
Figure 32:
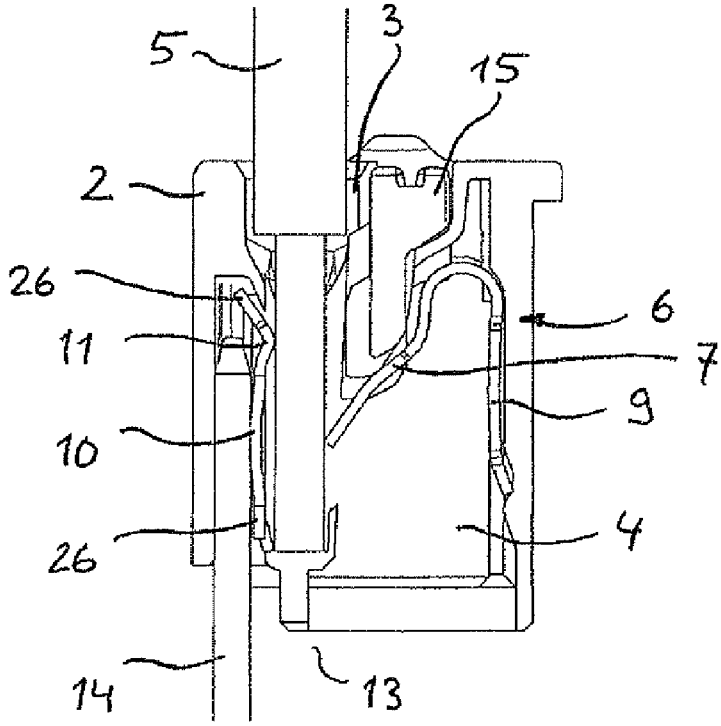
FIG. 32 shows a cross-sectional view of the plug-in connector from FIG. 31 with the contact pin inserted.

FIGS. 31 and 32 show an eighth embodiment of a plug-in connector 1 in which the busbar element 10 is supported firmly in the enclosure 2 of insulating material by bearings 26 in the upper and lower area transversely to the conductor entry direction. Below the bulge 11, a resilient contact area is formed which presses against the contact pin 14. On the opposite side, the contact pin 14 is counter-supported in the enclosure 2 of insulating material.

Figure 33:
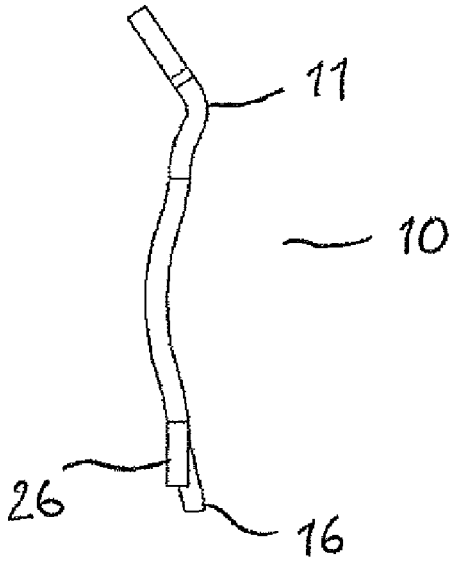
FIG. 33 shows a side view of the busbar element for the plug-in connector from FIG. 31.
Figure 34:
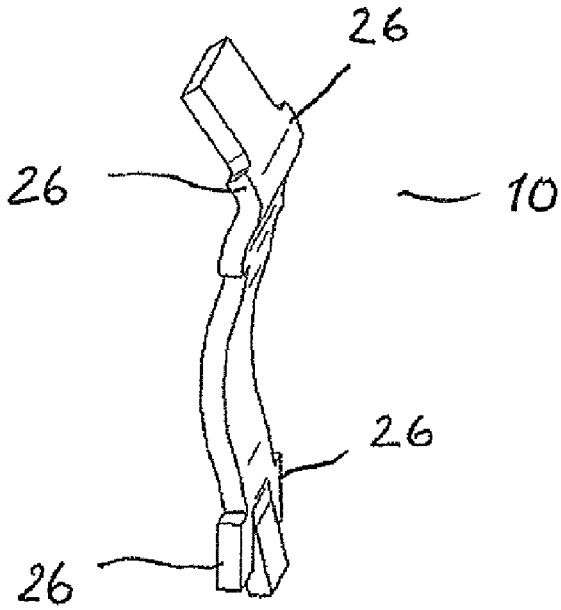
FIG. 34 shows a perspective view of the busbar element from FIG. 33.

FIGS. 33 and 34 again show the one-part busbar element 10 in a side view and in a perspective view. It becomes clear that the resilient contact area is curved toward the lower bearing 26 starting from the bulge 11.

The laterally protruding edges for forming the bearings can also be seen, which are accommodated in the enclosure 2 of insulating material so that the busbar element is firmly supported at the top and bottom.

Figure 35:
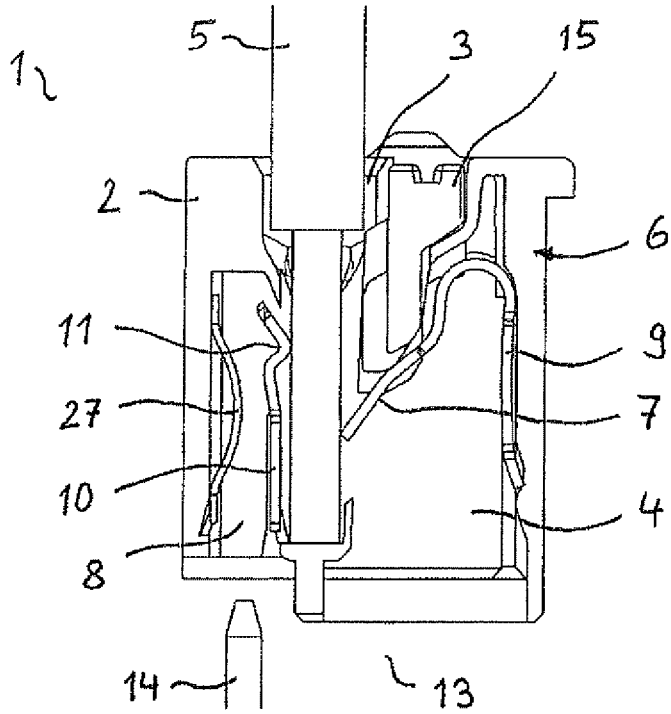
FIG. 35 shows a cross-sectional view of a ninth embodiment of a plug-in connector.
Figure 36:
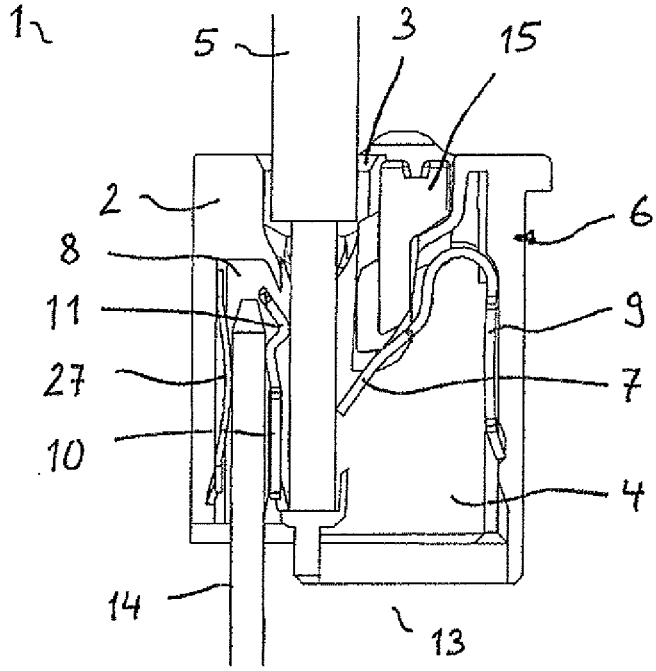
FIG. 36 shows a cross-sectional view of the plug-in connector from FIG. 35 with the contact pin inserted.

FIGS. 35 and 36 show a ninth embodiment of a plug-in connector in which the busbar element 10 is arranged similarly to the eighth embodiment in the enclosure of insulating material. The section below the bulge 11, however, is not resiliently bulging but rigid and forms a counter support for a contact pin 14. The contact pin 14, in contrast, is pressed in the direction of the conductor receiving space 4 and first part of the busbar element 10 via a spring element 27 on the opposite side, in order to bring the contact pin 14 electrically conductively into contact with the busbar element 10 with short current paths.

Figure 37:
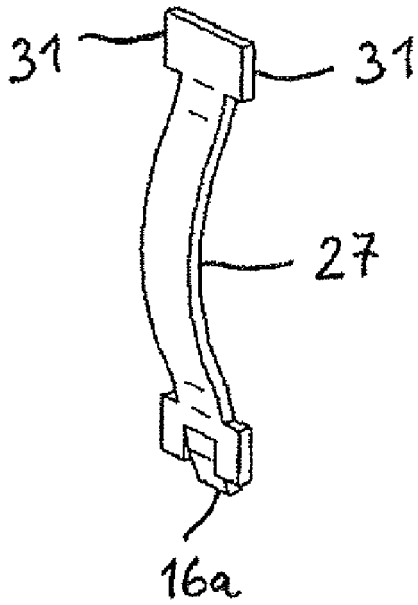
FIG. 37 shows a perspective view of the spring element from FIG. 36.

FIG. 37 shows the spring element 27 in a perspective view. It becomes clear that, at the lower end, a bent-away material tab 16*a* for localizing the spring element in the enclosure 2 of insulating material is provided. At the upper end, there are laterally protruding guide sections 31 which dip into guide grooves of the enclosure 2 of insulating material and secure a guided movement of the spring element 27.

Figure 38:
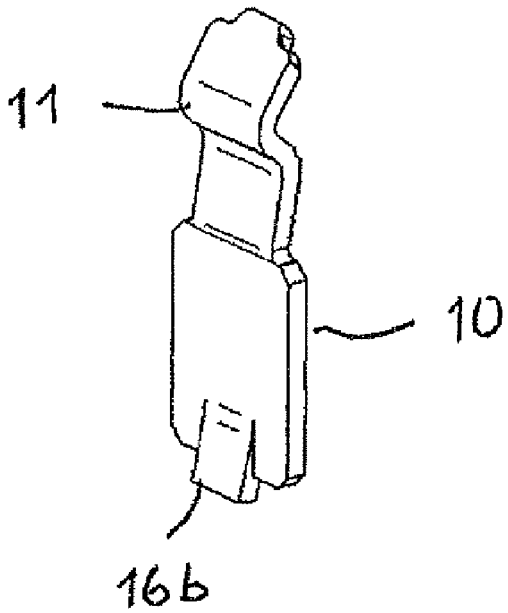
FIG. 38 shows a perspective view of the first part of the busbar element from FIG. 36.

FIG. 38 shows the first part of the busbar element 10 with the projection 11 obtained by a bend at the upper free end. At the lower free end, a bent-away material tab 16*b* is provided for localizing the first part of the busbar element 10 in the enclosure of insulating material.

Figure 39:
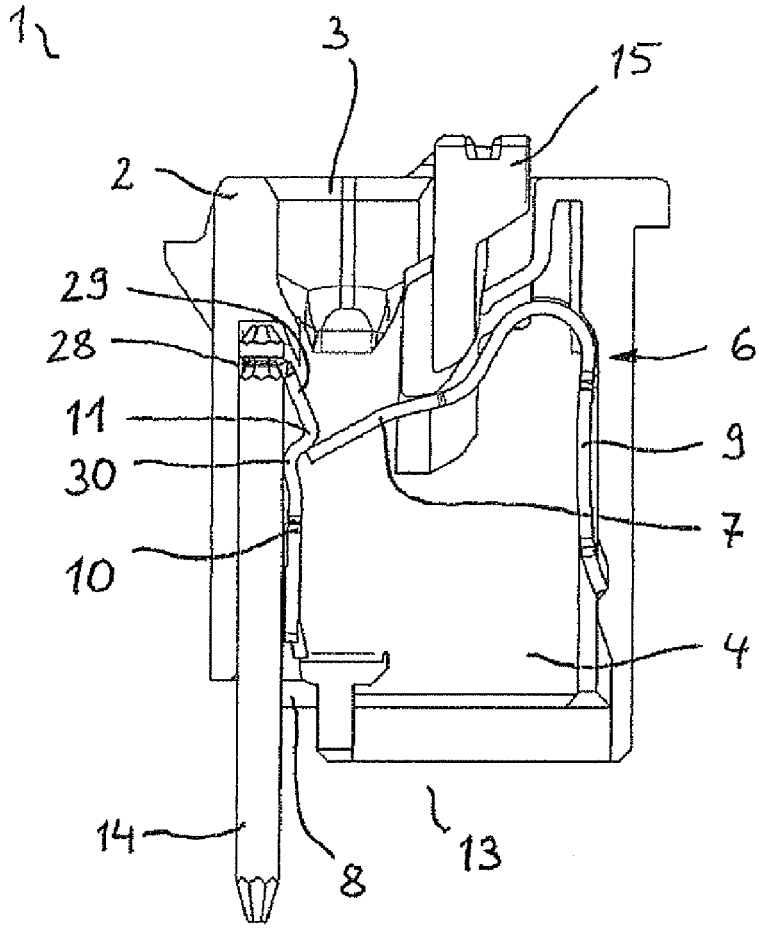
FIG. 39 shows a cross-sectional view of a tenth embodiment of a plug-in connector with the contact pin inserted and localized in the upper end area of the busbar element.

FIG. 39 shows a tenth embodiment of a plug-in connector 1 in which the contact pin 14 has at the upper free end an annularly encircling recess 28. The busbar element adjoining the contact pin 14 in the boundary area between contact pin 14 and electric conductor 5 and between conductor entry opening 3 and contact pin receiving opening 8, respectively, and located between contact pin receiving opening 8 and conductor connection space 4 has above the bulge a free end 29 angled away in the direction of the contact pin receiving opening 8. This free end 29 dips into the annular groove 28 in the contact pin 14 and holds the electric contact pin 14 tightly. The electric contact pin 14 rests against a supporting area 30 below the bulge 11 and there contacts the bulbar element 10 electrically conductively at a defined supporting point. The contact pin 14 is in this manner freely insertable, on the one hand, and subsequently firmly connected to the plug-in connector 1.

The invention claimed is:

1. Plug-in connector (1) comprising:

an enclosure (2) of insulating material, at least one conductor entry opening (3), open toward a conductor connection side of the plug-in connector (1), which in each case leads into an associated conductor connection space (4) in the enclosure (2) of insulating material for electrically conductively connecting an electric conductor (4) introduced into a conductor entry opening (3), in each case one clamping spring element (6) arranged in the conductor connection space (4), which element has a supporting leg (9) for localizing the clamping spring element (6), and a clamping leg (7) for clamping an electric conductor (5), at least one contact pin receiving opening (8), leading into in each case one associated conductor connection space (4) and open toward a contact pin connection side (13) different from the conductor connection side, for introducing contact pins (14), and in each case one or multi-part busbar element (10) in the conductor connection space (4) which is constructed for forming a clamping point for an associated electric conductor (5) in such a manner that an electric conductor (5) introduced into a conductor entry opening (3) is pressed against the busbar element (10) by the clamping leg (7) of the clamping spring element (6), characterized in that at least one part of the busbar element (10) is in each case arranged in the boundary area between an associated conductor entry opening (3) and an associated contact pin receiving opening (8) in such a manner that the part of the busbar element (10) is located between a contact pin (14) and an electric conductor (5) and electrically conductively rests against the contact pin (14) and the electric conductor (5) and the busbar element (10) has a resilient contact area in the contact pin receiving opening (8) for electrically contacting the busbar element (10) by a spring force with a contact pin (14) which can be introduced into an associated contact pin receiving opening (8).

2. Plug-in connector (1) according to claim 1, characterized in that the busbar element (10) is constructed as one piece and is bent over above the free end of a contact pin (14) which can be introduced into an associated contact pin receiving opening (8), and is constructed for resiliently contacting a contact pin (14) with its bent-over free end area (12).

3. Plug-in connector (1) according to claim 2, characterized in that the bend located above a contact pin (14) forms a resilient bend, and the free end area (12) of the busbar element (10) is resiliently preloaded in the direction of the boundary area part of the busbar element (10) in order to rest against a contact pin (14) by means of spring force.

4. Plug-in connector (1) according to claim 2, characterized in that the free end of the busbar element (10) in the contact pin receiving opening (8) is bent over in the direction of the conductor connection space (4) and has a fork (18) comprising two clamping legs (19*a*, 19*b*) between which a contact pin (14) can be clamped.

5. Plug-in connector (1) according to claim 1, characterized in that the busbar element (10) has, in the lower area opposite to the conductor entry opening (3), a fork (18), protruding into the contact pin receiving opening (8), forming the contact area, comprising two spaced-apart clamping legs (19*a*, 19*b*) for clamping a contact pin (14) at opposite sides of the contact pin (14).

6. Plug-in connector (1) according to claim 5, characterized in that the clamping legs (19*a*, 19*b*) of the busbar element (10) are bent away toward the top in the contact pin receiving opening (8) opposite the boundary area of an inlet of the contact pin receiving opening (8) in the enclosure (2) of insulating material in the direction of the inlet of the conductor entry opening (3) in the enclosure of insulating material in order to electrically contact a contact pin at mutually opposite side faces.

7. Plug-in connector (1) according to claim 1, characterized in that the busbar element (10) has at its two opposite side edges contact walls (25*a*, 25*b*), protruding into the contact pin receiving opening (8) and folded away from the part piece of the busbar element (10) located in the boundary area, for electrically contacting an intermediate contact pin (14).

8. Plug-in connector (1) according to claim 1, characterized in that the busbar element (10) has in the contact pin receiving opening (8) opposite the boundary area a spring element (27) acting in the direction of the conductor connection space (4) and resiliently pressing a contact pin (14) against the part of the busbar element (10) located in the boundary area.

9. Plug-in connector (1) according to claim 8, characterized in that the spring element (27) is a part of the busbar element (10) which is separate from the part of the busbar element (10) located in the boundary area.

10. Plug-in connector (1) according to claim 1, characterized in that the busbar element (10) has a first supporting part (22) located in the boundary area, extending in parallel with the direction of extension of the conductor entry opening (3) and contact pin receiving opening (8), and a second clamping part (23), connected to the first supporting part (22) and extending in the direction of the inlet of the contact pin receiving opening (8) in the enclosure (2) of insulating material for the contact pin (14) and protruding into the contact pin receiving opening (8), with two contact legs (24*a*, 24*b*), mutually spaced apart for receiving an intermediate contact pin (14), and mutually spring-loaded, for clamping a contact pin (14).

11. Plug-in connector (1) according to claim 1, characterized in that the busbar element (10) has in the boundary area a bulge (11) protruding from the contact pin receiving opening (8) into the conductor entry opening (3), which bulge provides a reduced supporting area for an electric conductor (5) pressed against the busbar element (10) by the clamping spring (6).

* * * * *